US012291815B2

(12) United States Patent
Thielen

(10) Patent No.: US 12,291,815 B2
(45) Date of Patent: May 6, 2025

(54) METHOD FOR OPERATING A GRIPPING DEVICE FOR SEPARATING LAUNDRY ITEMS FROM A LAUNDRY PILE

(71) Applicant: Thielen Automation GmbH, Badem (DE)

(72) Inventor: Bernd Thielen, Oberkail (DE)

(73) Assignee: Thielen Automation GmbH, Badem (DE)

( * ) Notice: Subject to any disclaimer, the term of this patent is extended or adjusted under 35 U.S.C. 154(b) by 0 days.

(21) Appl. No.: 18/561,504

(22) PCT Filed: May 23, 2022

(86) PCT No.: PCT/DE2022/100392

§ 371 (c)(1),
(2) Date: Nov. 16, 2023

(87) PCT Pub. No.: WO2022/242808

PCT Pub. Date: Nov. 24, 2022

(65) Prior Publication Data

US 2024/0240386 A1 Jul. 18, 2024

(30) Foreign Application Priority Data

May 21, 2021 (DE) ..... 10 2021 113 345.9

(51) Int. Cl.
*D06F 93/00* (2006.01)
*D06F 95/00* (2006.01)

(52) U.S. Cl.
CPC ..... *D06F 93/00* (2013.01); *D06F 95/00* (2013.01)

(58) Field of Classification Search
CPC ... B25J 15/0028; B25J 15/0616; B65B 35/18; B65B 43/46; B65H 3/00; B65H 3/08;
(Continued)

(56) References Cited

U.S. PATENT DOCUMENTS 3,092,263 A 6/1963 Beaudry et al.
4,036,365 A * 7/1977 Rosenfeld ..... B07C 5/3412 209/3.3

(Continued)

FOREIGN PATENT DOCUMENTS

EP 0612676 A1 * 8/1994 ..... B65H 3/22
EP 0 771 746 A1 5/1997

(Continued)

OTHER PUBLICATIONS

International Search Report in PCT/DE2022/100392, mailed Sep. 2, 2022.

(Continued)

*Primary Examiner* — Gregory W Adams
(74) *Attorney, Agent, or Firm* — Collard & Roe, P.C.

(57) ABSTRACT

A method operates a gripping device for separating laundry items from a laundry pile. The gripping device has a suction nozzle unit for suctioning a laundry item lying on the pile that has a nozzle assembly with at least one nozzle and a device for generating a vacuum at the suction nozzle unit opening. The gripping device has gripping elements, which are closed in cooperation so that the gripping elements grip the laundry item in the closed state. The suction nozzle unit opening has a distance from the laundry pile greater than "0" when suction of a laundry item begins. The gripping elements close when a laundry item has been sucked up by the suction nozzle unit so that the suction nozzle unit opening is covered by the laundry item. The laundry item is only partially lifted from the laundry pile when the gripping elements close.

10 Claims, 3 Drawing Sheets

(58) Field of Classification Search
CPC .. B65H 3/0808; B65H 3/0816; B65H 3/0883; D06F 93/00; D06F 95/00; D06F 67/04
See application file for complete search history.

(56) References Cited

U.S. PATENT DOCUMENTS

| | | | | |
|---|---|---|---|---|
| 4,527,327 | A * | 7/1985 | Van Deuren | H05K 13/0408 29/840 |
| 4,950,011 | A * | 8/1990 | Borcea | H05K 13/0409 294/183 |
| 8,132,835 | B2 * | 3/2012 | Ban | B25J 15/0616 294/183 |
| 9,920,470 | B2 | 3/2018 | Tautz et al. | |
| 10,569,422 | B2 * | 2/2020 | Curhan | B25J 15/0023 |
| 2019/0217481 | A1 * | 7/2019 | Lessing | B25J 15/0023 |
| 2020/0346792 | A1 * | 11/2020 | Curhan | B25J 15/10 |

FOREIGN PATENT DOCUMENTS

| | | | |
|---|---|---|---|
| EP | 0 941 951 | A1 | 9/1999 |
| EP | 2 677 078 | A1 | 12/2013 |
| EP | 2 930 264 | A1 | 10/2015 |
| FR | 2 660 638 | A1 | 10/1991 |
| JP | S56-124628 | U | 9/1981 |
| JP | S61-165982 | U | 10/1986 |
| JP | S63-111900 | U | 7/1988 |
| JP | S64-60528 | A | 3/1989 |
| JP | H02-116142 | A | 4/1990 |
| JP | H07-328294 | A | 12/1995 |
| JP | H08-299699 | A | 11/1996 |
| JP | 2009-078316 | A | 4/2009 |
| JP | 2020-046197 | A | 3/2020 |
| WO | 96/33936 | A1 | 10/1996 |

OTHER PUBLICATIONS

English translation of the International Preliminary Report on Patentability in PCT/DE2022/100392, dated Dec. 7, 2022.
European Attorney's response to International Preliminary Report on Patentability filed Sep. 16, 2022.

* cited by examiner

METHOD FOR OPERATING A GRIPPING DEVICE FOR SEPARATING LAUNDRY ITEMS FROM A LAUNDRY PILE

CROSS REFERENCE TO RELATED APPLICATIONS

This application is the National Stage of PCT/DE2022/100392 filed on May 23, 2022, which claims priority under 35 U.S.C. § 119 of German Application No. 10 2021 113 345.9 filed on May 21, 2021, the disclosure of which is incorporated by reference. The international application under PCT article 21(2) was not published in English.

BACKGROUND OF THE INVENTION

1. Field of the Invention

The present invention relates to a method for operating a gripping device for separating laundry items from a laundry pile.

2. Description of the Related Art

Such a method is known from EP 0 771 746 A1.

When separating laundry items from a laundry pile, it is important in terms of process reliability that gripping several laundry items at the same time is largely avoided. Another important aspect is the cycle time required to perform a gripping operation. This applies in particular to industrial laundries, where commercial laundry is treated throughout. This treatment includes, in particular, a washing process. For a laundry sorting process, it is important to separate the laundry items in the process in order to be able to evaluate the laundry items individually.

The known gripping device has a suction nozzle unit for sucking up a laundry item lying on the laundry pile. The suction nozzle unit has a nozzle assembly, which consists of at least one nozzle. The suction nozzle unit has a device for generating a vacuum at the opening of the nozzle unit.

The gripping device has gripping elements, which are closed in cooperation in such a way that the gripping elements grip the laundry item in the closed state.

In the subject matter of EP 0 771 746 A1, the suction nozzle unit can be moved relative to the gripping elements in the gripping device in such a way that the distance from the suction nozzle unit to the laundry pile can be varied relative to the distance from the gripping elements to the laundry pile:

- from a first position, in which the distance from the suction nozzle unit to the laundry pile is less than the distance from the gripping elements to the laundry pile,
- to a second position, in which the distance from the suction nozzle unit to the laundry pile is greater than the distance from the gripping elements to the laundry pile.

A gripping process is performed by the sequence of the following steps:

- First step: Starting from the first position, in which the suction nozzle unit generates a vacuum and in which the gripping elements are open,
- Second step: Transition into the second position,
- Third step: Closing the gripping elements.

The known gripping device is operated according to the known solution by lowering the suction nozzle unit onto the laundry pile such that the suction nozzle unit touches the laundry pile. The vacuum is generated in this position and the suction nozzle unit is moved away from the laundry pile in relation to the gripping elements.

Such a procedure is also described in U.S. Pat. No. 3,092,263 A. There, too, a suction nozzle unit is lowered onto a laundry pile so that the suction nozzle unit touches this laundry pile. It is described that a vacuum is generated such that the laundry item is sucked up when it is in contact with the opening of the suction nozzle unit. It is further described that when the suction nozzle unit is lifted, this laundry item is lifted from the laundry pile. If the laundry item is completely lifted from the laundry pile and hangs freely, the laundry item passes through a light barrier when it is lifted. Immediately after the light barrier has been passed through completely, a gripping device closes above this light barrier to hold the laundry item mechanically. This is intended to ensure that the laundry item—which is a towel—is held in a defined position at one corner by the gripping device. The position of the suction nozzle unit on the surface of the towel is statistically distributed during the suction processes because it is a disorganized laundry pile. If the position of the suction nozzle unit is not centered in relation to the surface of the towel, the towel will hang down from the suction nozzle unit so that one corner hangs lower than the other corners. The light barrier is only released again when this (lowest hanging) corner has passed the light barrier. By closing the gripping device at this moment, it is possible to ensure that the gripping device only grips the one corner that is currently hanging lowest. In cases where the towel does hang "symmetrically" downwards, there is the option of not closing the gripping device and switching off the vacuum. The towel then falls back down onto the laundry pile so that a new grabbing process can be carried out.

SUMMARY OF THE INVENTION

The object of the present invention is to propose a method for improving the separation of laundry items from a laundry pile.

To this end, the method according to a first aspect of the invention has the following steps. To operate a gripping device for separating laundry items from a laundry pile, the gripping device has a suction nozzle unit for sucking up a laundry item lying on the laundry pile. The suction nozzle unit has a nozzle assembly, which consists of at least one nozzle. The suction nozzle unit has a device for generating a vacuum at the opening of the suction nozzle unit. The gripping device has gripping elements, which can be closed in cooperation in such a way that the gripping elements grip a laundry item in the closed state.

According to the present invention, the opening of the suction nozzle unit has a distance (X) from the laundry pile that is greater than "0" when suction of a laundry item begins. The gripping elements close when a laundry item has been sucked up by the suction nozzle unit in such a way that the opening of the suction nozzle unit is covered by the laundry item. The laundry item is only partially lifted from the laundry pile when the gripping elements close.

The distance X can be in the range of a few centimeters, for example, between one centimeter and 20 centimeters, preferably between one centimeter and 10 centimeters, particularly preferably between one centimeter and five centimeters, particularly preferably between one centimeter and four centimeters.

It has been shown that by maintaining the distance X from the opening of the suction nozzle unit to the laundry pile in the first position and thus also in the first step, process reliability is improved. Unintentional grabbing of several laundry items therefore occurs less frequently.

This advantage can be explained by the fact that when the vacuum and the suction flow of the suction nozzle unit act on the laundry pile, only the laundry item lying on top of the laundry pile is lifted more securely than if the suction nozzle unit touches the laundry pile directly.

This can be explained as follows: First, air is sucked in. The top laundry item is lifted until it reaches the nozzle. The laundry item below it is "in the laundry stack". When a laundry item is lifted, the pressure above the laundry item is lower than the pressure below the laundry item. Due to the vacuum above the laundry stack, this works for the top laundry item. This only works to a limited extent for the next laundry item. The pressure above the laundry item, in the laundry pile that is not "on top", is only moderately reduced by the suction nozzle because this air must also flow through the fabric of the top laundry item.

Positioning the suction nozzle above the laundry stack at a certain distance X means that—to a large extent—only one laundry item is reliably lifted (compared to lifting several laundry items when the suction nozzle is "placed on top").

It also proves to be advantageous that the laundry item is already gripped by the gripping elements when the laundry item has not yet been completely lifted off the laundry pile. If the laundry item is partially under other laundry items in the laundry pile, the vacuum may not be sufficient to detach the laundry item from the laundry pile if the suction nozzle unit is only lifted by the vacuum generated. It then proves advantageous if the laundry item has been gripped by the gripping elements and is lifted off the laundry pile when the gripping elements are lifted.

Advantageously, the laundry item can initially be lifted a little after suction using only the suction nozzle unit. This ensures that a laundry item accidentally sucked in (in addition to the item to be lifted) falls off again before the gripping elements close. As explained, the gripping elements close before the laundry item is completely lifted off the laundry pile.

In an embodiment, a routine for error handling is performed if, after the vacuum has been generated with the suction nozzle unit at an existing distance X from the laundry pile, it is recognized that no laundry item is being sucked up. In the course of this error routine, the distance (X) is reduced and/or a stronger vacuum is built up. This occurs until the sucking up of a laundry item has been recognized.

This is advantageous for adjusting the parameters of the process if, for example, the laundry items in the laundry pile are tangled together in such a way that (initially) no laundry items are lifted from the laundry pile. Another reason may be that the laundry pile contains (at least some) laundry items made of a fabric with a high specific weight. A stronger vacuum is also required to (partially) lift such laundry items.

This stronger vacuum can be achieved by generating a stronger vacuum in the suction nozzle unit. The distance (X) between the opening of the suction nozzle unit and the laundry pile can also be reduced.

Alternatively or additionally, a further error routine according to a third embodiment may be designed such that on recognizing that no laundry items have been sucked up, the gripping elements are closed such that these gripping elements grip the top part of the laundry pile. The vacuum can then be switched off. If necessary, the gripping elements must be lowered before closing so that they grip a top part of the laundry pile when closing. After closing the gripping elements, they are lifted with the gripped top part of the laundry pile. The gripping elements are then opened in the lifted position, such that the lifted top part of the laundry pile falls back onto the laundry pile.

This loosens up the laundry pile so that when the laundry items are subsequently separated, items that were previously tangled together in the laundry pile may be sucked up again.

If necessary, the gripping elements can perform a shaking movement in the lifted position before opening in order to promote the release of the lifted laundry items.

In another embodiment of the method, on recognizing that several laundry items are gripped by the gripping elements after one laundry item has been sucked up by the suction nozzle unit, the following steps are performed. First, the gripping elements are lifted into a position in which the gripped laundry items are lifted from the laundry pile. In this lifted position, the gripping elements are opened such that the gripped laundry items fall back onto the laundry pile.

Advantageously, this procedure can also be used to detach tangled laundry items from each other so that these laundry items can be gripped individually in a subsequent gripping process.

In another embodiment of the method, the suction nozzle unit and the gripping elements can be moved relative to one another in such a way that the distance (X) from the suction nozzle unit to the laundry pile can be varied with respect to the distance from the gripping elements to the laundry pile. This variation can take place from a first position, in which the distance (X) from the opening of the suction nozzle unit to the laundry pile is less than the distance from the gripping elements to the laundry pile, to a second position, in which the distance from the opening of the suction nozzle unit to the laundry pile is greater than the distance from the gripping elements to the laundry pile. A gripping process is performed by the following steps:

First step: In the first position, a vacuum is generated in the suction nozzle unit and the gripping elements are open.

Second step: After sucking up a laundry item, a transition into the second position occurs, in which second position the suction nozzle unit in the gripping device is moved away from the laundry pile relative to the gripping elements.

Third step: The gripping elements are closed.

In another embodiment of the method, the gripping elements close with a rotation around a rotation point. The length of the gripping elements starting from the center of rotation of the rotary movement is greater than the length of the suction nozzle unit starting from the center of rotation of the rotary movement of the gripping elements. The gripping elements are closed with a rotary movement after a laundry item has been sucked up by the suction nozzle unit.

In the embodiment, the gripping elements are long enough that, when closed, they grip a laundry item sucked up by the suction nozzle unit "below" the opening of the suction nozzle unit. Advantageously, the design of the gripping device can thus be simplified compared to an embodiment, because the suction nozzle unit no longer has to be movable relative to the gripping elements in the gripping device. In the embodiment, the gripping device—if necessary—is raised as a whole from the laundry pile before the gripping elements are closed, so that the gripping elements close above the laundry pile. The gripping elements only grip the laundry item that has been sucked up by the suction nozzle unit and which is therefore lifted from the laundry pile when the gripping device is lifted.

In another embodiment, after switching on the device to generate a vacuum, the device is operated at a first power level. After recognizing that a laundry item has been sucked up, the device is operated at a second power level, wherein the second power level is lower than the first power level.

The advantage of this is that the first (higher) power level enables the laundry item to be lifted. If it is recognized that the laundry item has been sucked up in such a way that this laundry item covers the opening of the suction nozzle unit, the power level is advantageously reduced. It has been shown that this lower power level during operation of the device is sufficient to hold the laundry item in the position in which this laundry item covers the opening of the suction nozzle unit.

By reducing the power level, it is advantageously prevented that a laundry item is sucked up that is located below the top laundry item that is to be gripped individually.

If another laundry item has already been accidentally sucked up, reducing the power level of the device for generating a vacuum can be advantageous in ensuring that this laundry item falls off again.

If the device for generating the vacuum has an electric motor, the electrical power absorbed by the electric motor is defined by the electrical voltage applied to the terminals of the electric motor and by the mechanical load opposing the movement of the electric motor. In this case, the power level is reduced by reducing the electrical voltage applied to the terminals of the electric motor.

According to another embodiment, a laundry item being sucked up is recognized by evaluating one or more of the following variables:

- Speed change of the drive unit of the device for generating a vacuum,
- Power consumption of the drive unit of the device for generating a vacuum,
- Change in the air flow rate when the device is switched on,
- Change in pressure inside the nozzle unit,
- Visual evaluation.

The evaluation of the speed change of the drive unit of the device for generating a vacuum is useful insofar as the air flow rate is reduced when a laundry item is sucked up in such a way that the opening of the suction nozzle unit is covered. This leads to a drop in the speed of the device for generating a vacuum. This drop in speed can be evaluated.

If the opening of the suction nozzle unit is covered by a laundry item, the power consumption of the device for generating a vacuum increases. If such a sudden increase in power consumption is detected, it can also be deduced that a laundry item has been sucked up.

The two effects described occur if the device for generating a vacuum has an electric motor. If the air flow rate is reduced because the air flowing through is opposed by a higher flow resistance, the speed of the electric motor drops. This results in a higher power consumption of the electric motor if a constant voltage is applied to its terminals.

It is also possible to analyze a change in the air flow rate when the device is switched on. This change in the air flow rate occurs directly in connection with a laundry item covering the opening of the suction nozzle.

It is also possible to evaluate the change in pressure inside the suction nozzle unit. This can also be used to detect whether the opening of the suction nozzle unit is covered by a laundry item.

The evaluation of all these measured variables shows that when the device for generating a vacuum is switched on when the opening of the suction nozzle unit is above the laundry pile, the regulation of the power level of the device for generating a vacuum within the meaning of the third embodiment functions better. The abrupt change in the respective measured variable is then due to the fact that immediately after the device for generating a vacuum is switched on, the opening of the suction nozzle unit is still free and a corresponding amount of air flows through the opening of the suction nozzle unit. If the laundry item is sucked up and covers the opening of the suction nozzle unit, this leads to a sudden change in the respective variable. This sudden change can be recognized with great certainty and also with a short time delay.

It is also possible to provide a visual evaluation. This visual evaluation can consist of a light barrier, which is located below the suction nozzle unit or inside the suction nozzle unit near the opening of the suction nozzle unit. The visual evaluation can also consist of capturing the entire area with a camera such that an image evaluation can recognize whether a laundry item is covering the opening of the suction nozzle unit.

In another embodiment, the power level at which the device for generating a vacuum in the suction nozzle unit is operated is dependent on recognizing the type of fabric of the laundry item in the laundry pile.

If it is a fabric with a high specific weight, the power level can be set higher than for a fabric with a lower specific weight.

The type of fabric can be recognized by tagging the laundry items in the laundry pile with an RFID chip. By analyzing the RFID chips—in addition to other data—it is then possible to recognize whether the fabric has a higher or lower specific weight. It can also be used to recognize whether the fabric is rather dense or whether it has pores through which air can flow.

It is also possible to recognize the type of fabric by evaluating the laundry pile with a camera arrangement.

In another embodiment, the device for generating a vacuum is switched off if the gripping elements are closed.

This makes sense because the individual laundry items are then kept separate by the gripping elements. This laundry item can then be lifted further away from the laundry pile. The generation of a vacuum by the suction nozzle unit is no longer required in this situation.

In another embodiment of the method, the shape and position of the laundry pile is detected. A desired position for the opening of the suction nozzle unit is determined from the shape and position of the laundry pile in such a way that the opening of the suction nozzle unit is at a distance (X) from the laundry pile when this desired position is reached. The gripping device is moved to this target position to perform the first step.

It has proven useful to position the gripping device above the highest point of the laundry pile to carry out the method. The laundry item on top is less likely than other laundry items in the laundry pile to be partially below other laundry items. This facilitates the laundry items being sucked up and subsequently lifted from the laundry pile when the separation is carried out.

When the shape and position of the laundry pile is detected, a target position can also be defined, which is located at a distance X above the highest point of the laundry pile.

Identifying such a target position for the opening of the suction nozzle unit has considerable advantages for increasing the cycle frequency. When a laundry item has been gripped and separated, this laundry item is lifted off the laundry pile by moving the gripping device away from the laundry pile. Once this laundry item has been deposited, the gripping device must be repositioned relative to the laundry pile in order to be able to separate and grip the next laundry item. Because the position of the opening of the suction nozzle should be at a distance X from the laundry pile, this positioning cannot simply be achieved by moving the gripping device towards the laundry pile until it hits the laundry pile. Once the target position has been determined, a trajectory for an optimum movement sequence to reach the target position can be determined based on the current position of the opening of the suction nozzle unit. Similarly, a speed profile along this trajectory can be defined in such a way that the gripping device is moved along the trajectory at the highest possible speed and is simultaneously braked in good time before reaching the target point, such that the opening of the suction nozzle unit is just braked and comes to a standstill when the target position is reached.

BRIEF DESCRIPTION OF THE DRAWINGS

An exemplary embodiment of the invention is shown in the drawing. In the figures.

DETAILED DESCRIPTION OF PREFERRED EMBODIMENTS

FIGS. 1 to 4 shows representations of a gripping device 1 having a suction nozzle unit 2 and gripping elements 3, 4 above a laundry pile 5 in different positions and operating states.

Figure 1:
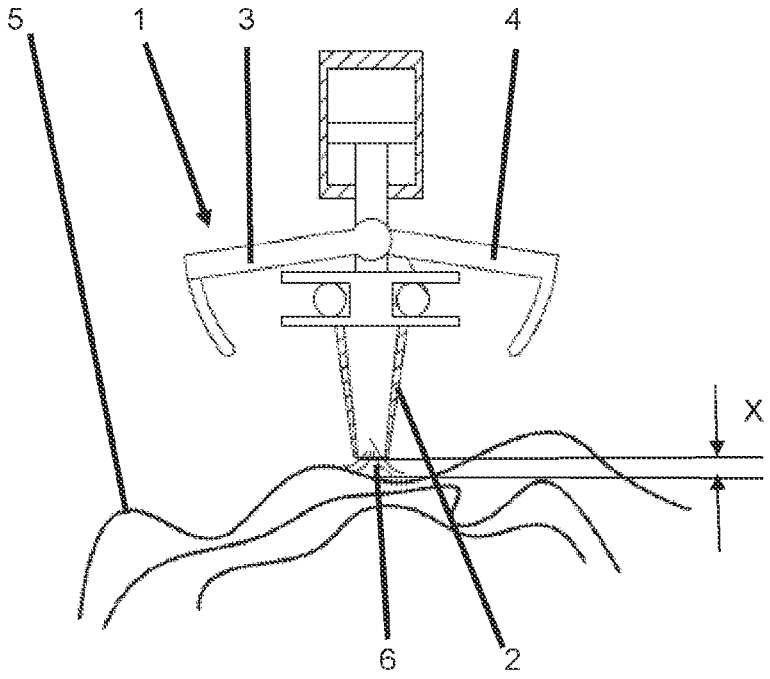
FIGS. 1 to 4 show: representations of a gripping device with a suction nozzle unit and gripping elements above a laundry pile in different positions and operating states.

FIG. 1 shows the gripping device 1 in which said gripping device 1 is located above the laundry pile 5. It can be seen that the opening 6 of the suction nozzle unit 2 has a distance X from the laundry pile 5, which is greater than "0".

In the representation of FIG. 1, it can be seen that air flows in through the opening 6 of the suction nozzle unit 2, is sucked up from the side of the suction nozzle unit 2 and flows between the opening 6 of the suction nozzle unit 2 and the laundry pile 5.

It can be seen that the gripping elements 3 and 4 and open.

The device for generating a vacuum in the suction nozzle unit 2 is in operation in the representation in FIG. 1. As a result, the air is sucked up and flows between the laundry pile 5 and the opening 6 of the suction nozzle unit 2 into the opening 6 of the suction nozzle unit 2. Thus, a vacuum is generated.

In this first position, the opening 6 of the suction nozzle unit 2 is closer over the laundry pile 5 than the gripping elements 3 and 4. In the exemplary embodiment shown, this is already due to the fact that the two gripping elements 3 and 4 are open and protrude laterally in an upper position—above the opening 6 of the suction nozzle unit 2.

Figure 2:
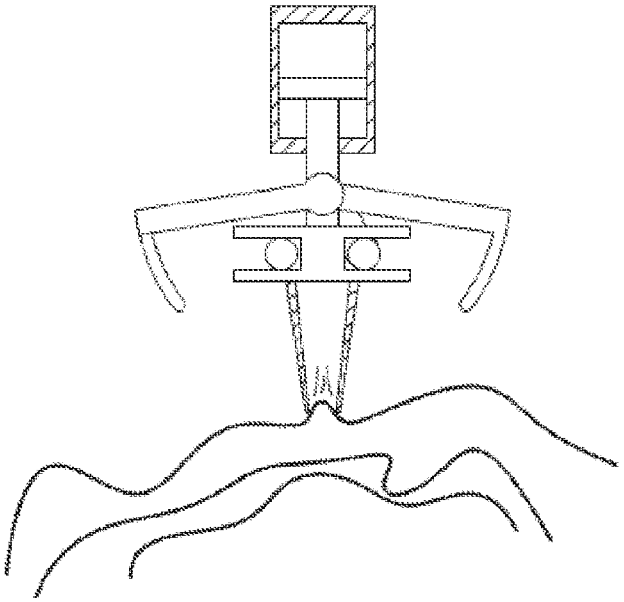

FIG. 2 shows the situation as in FIG. 1 with the difference that, as a result of the vacuum, the top laundry item of the laundry pile 5 has been sucked up so far that this laundry item covers the opening 6 of the suction nozzle unit 2.

The gripping device 1 shown in FIGS. 1 to 4 relates to an embodiment in which the suction nozzle unit 2 in the gripping device 1 can be moved in a vertical direction relative to the gripping elements 3 and 4. This is symbolized by the arrow 301 in FIG. 3.

By lifting the suction nozzle unit 2 in the gripping device 1, the sucked-up laundry item is lifted further away from the laundry pile.

The two arrows 302 and 303 refer to the rotary movement of the two gripping elements 3 and 4 when closing. It can be seen that the two gripping elements 3 and 4 close above the laundry pile 5. It is again advantageous that the suction nozzle unit 2 is moved upwards relative to the gripping elements 3 and 4, so that the sucked-up laundry item is located between the gripping elements 3 and 4 before they are closed.

In addition, the relative movement of the suction nozzle unit 2 relative to the gripping elements 3 and 4 in the gripping device 1 ensures that the gripping elements 3 and 4 close below the opening 6 of the suction nozzle unit 2.

Figure 4:
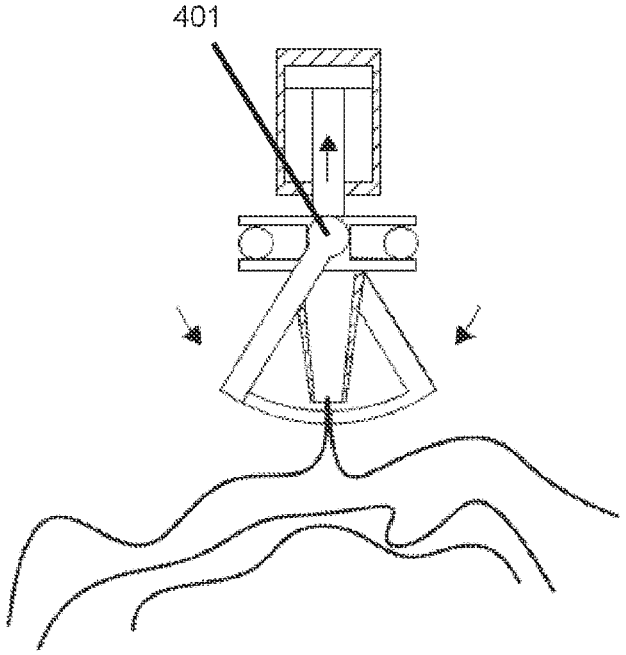

FIG. 4 shows the gripping device 1 in the position in which the suction nozzle unit 2 in the gripping device 1 has been moved upwards relative to the gripping elements 3 and 4 and in which the gripping elements 3 and 4 are closed and thus grip the laundry item. It can be seen that the device for generating a vacuum is switched off. The laundry item is held solely by the closed gripping elements 3 and 4.

Figure 3:
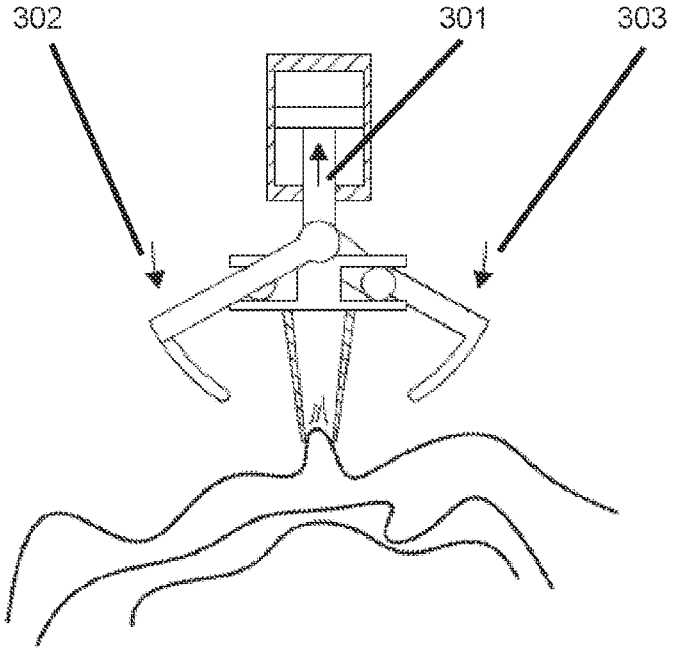

With reference to FIGS. 3 and 4, it can be explained that it is not absolutely necessary for the implementation of the present invention that the suction nozzle unit 2 in the gripping device 1 can be moved upwards relative to the gripping elements 3 and 4 (i.e. the movement corresponding to the arrow 301 is not absolutely necessary). The assignment of the position of the suction nozzle unit 2 to the center of rotation 401 of the gripping elements 3 and 4 can also be carried out statically, as shown in FIG. 4. The gripping elements 3 and 4 thus close below the opening 6 of the suction nozzle unit 2. If the two gripping elements 3 and 4 are rotated as far as shown in FIGS. 1 and 2 during opening, the two gripping elements 3 and 4 are located above the opening 6 of the suction nozzle unit 2 even if the suction nozzle unit 2 is positioned (statically) as far up inside the gripping device 1 as shown in FIG. 4. It is then also possible with such an embodiment to position the opening 6 of the suction nozzle unit 2 above the laundry pile 5 at a distance X, so that the gripping elements 3 and 4 are nevertheless further away from the laundry pile 5 than the opening 6 of the suction nozzle unit 2. This embodiment corresponds to the second alternative mentioned in the first aspect of the invention for the implementation of the second step.

Figure 5:
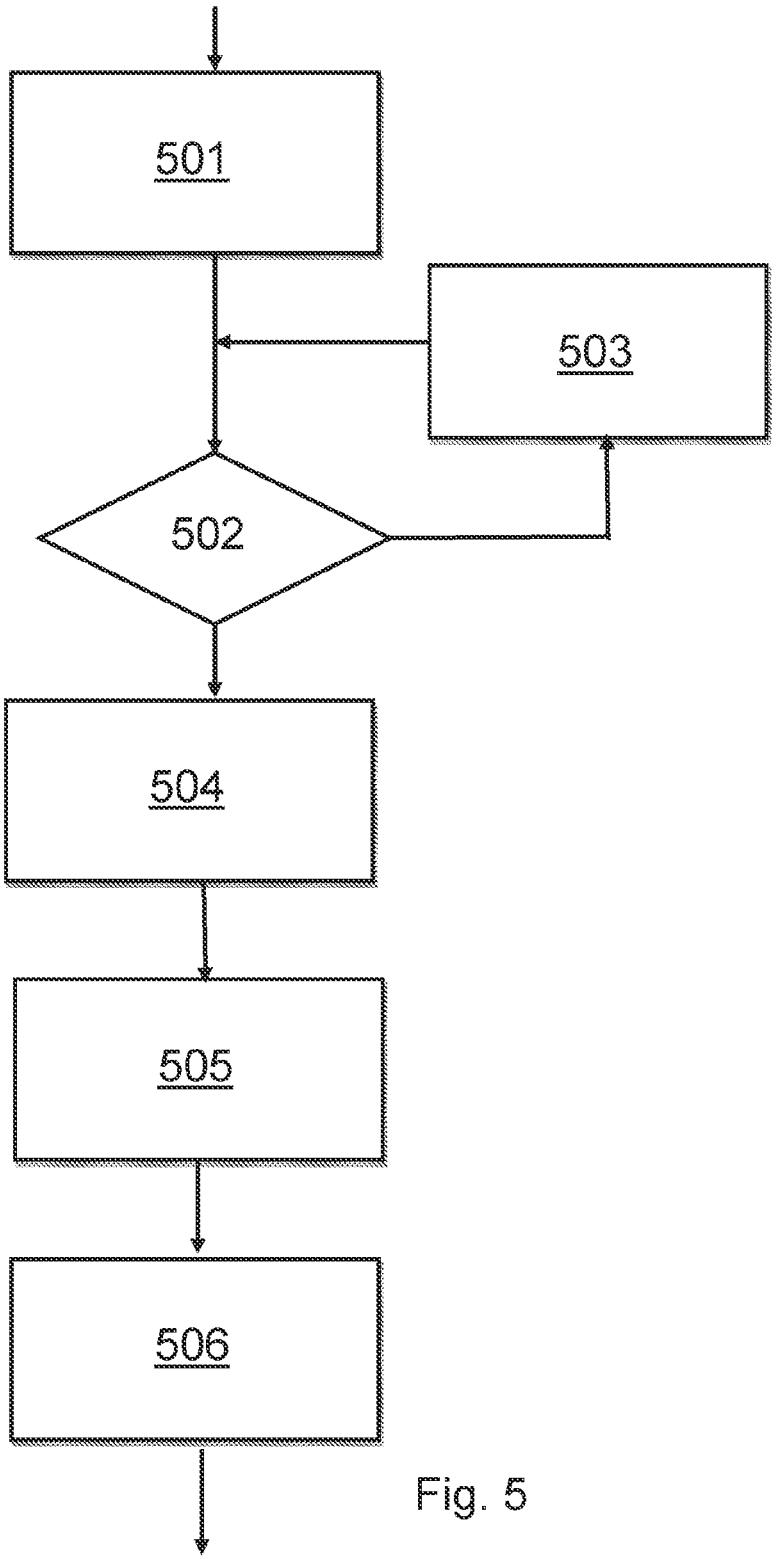
FIG. 5: shows a block diagram representing the sequence of the method according to the present invention.

FIG. 5 shows a block diagram representing the sequence of the method according to the present invention.

A cycle of the method starts in the function block 501. The suction nozzle unit is at a certain distance X from the top of the laundry pile. The device for generating a vacuum is switched on.

The function block 502 checks whether a laundry item has been sucked up after a certain time has elapsed such that this laundry item covers the opening of the suction nozzle unit. This cycle can be carried out by evaluating one of the variables mentioned in connection with the third embodiment.

If it is recognized that no laundry items have been sucked up even after a certain time has elapsed, the suction nozzle unit can be positioned closer to the laundry pile (reducing the distance X) and/or the power of the device for generating a vacuum can be increased in accordance with the representation of the function block 503.

If a laundry item has been sucked up, the power of the device for generating a vacuum can be reduced in accordance with the function block 504.

The suction nozzle unit is retracted relative to the gripping elements in accordance with the function block 505. If the gripping elements according to the description of the first aspect of the invention in the second alternative of the second step are sufficiently long compared to the length of the suction nozzle unit, the gripping device as a whole can also be lifted off the laundry pile so that the gripping elements close above the laundry pile in the subsequent step of the function block 506.

According to the function block 506, the gripping elements are closed and the drive unit is switched off to generate a vacuum.

The invention claimed is:

1. A method for operating a gripping device (1) for separating laundry items from a laundry pile (5), wherein the gripping device (1) has a suction nozzle unit (2) for sucking up a laundry item lying on the laundry pile (5), wherein the suction nozzle unit (2) has a nozzle assembly, which consists of at least one nozzle, wherein the suction nozzle unit (2) has a device for generating a vacuum at the opening (6) of the suction nozzle unit (2), wherein the gripping device (1) has gripping elements (3, 4), which are closed in cooperation in such a way that the gripping elements (3, 4) grip the laundry item in the closed state, wherein the opening (6) of the suction nozzle unit (2) has (201) a distance (X) from the laundry pile (5) that is greater than "0" when suction of a laundry item begins, the gripping elements (3, 4) close when a laundry item has been sucked up by the suction nozzle unit (2) in such a way that the opening (6) of the suction nozzle unit (2) is covered by the laundry item, and the laundry item is only partially lifted from the laundry pile (5) when the gripping elements (3, 4) close, and wherein the suction nozzle unit (2) and the gripping elements (3, 4) can be moved relative to one another such that the distance (X) from the suction nozzle unit (2) to the laundry pile (5) can be changed relative to the distance from the gripping elements (3, 4) to the laundry pile (5):

from a first position, in which the distance (X) from the opening (6) of the suction nozzle unit (2) to the laundry pile (5) is less than the distance from the gripping elements (3, 4) to the laundry pile (5), to a second position, in which the distance from the opening (6) of the suction nozzle unit (2) to the laundry pile (5) is greater than the distance from the gripping elements (3, 4) to the laundry pile, wherein a gripping process is performed with the following steps:

First step: In the first position, a vacuum is generated in the suction nozzle unit (2) and the gripping elements (3, 4) are open, Second step: After sucking up a laundry item, a transition into the second position occurs, in which second position the suction nozzle unit (2) in the gripping device (1) is moved away from the laundry pile (5) relative to the gripping elements (3, 4), Third step: The gripping elements (3, 4) are closed.

2. The method according to claim 1, wherein when a vacuum is generated in the suction nozzle unit without recognizing the sucking up of a laundry item the distance (X) is reduced and/or a stronger vacuum is built up until the sucking up of a laundry item has been recognized.

3. The method according to claim 1, wherein on recognizing that no laundry items have been sucked up, the gripping elements (3, 4) are closed such that said gripping elements (3, 4) grip the top part of the laundry pile (5), the gripping elements (3, 4) are then lifted after gripping the top part of the laundry pile (5), the gripping elements (3, 4) are then opened in the lifted position, such that the lifted top part of the laundry pile (5) falls back onto the laundry pile.

4. The method according to claim 1, wherein on recognizing that several laundry items are gripped by the gripping elements after one laundry item has been sucked up by the suction nozzle unit (2), the gripping elements (3, 4) are lifted into a position in which the gripped laundry items are lifted from the laundry pile, and the gripping elements (3, 4) are opened in this lifted position such that the gripped laundry items fall back onto the laundry pile (5).

5. The method according to claim 1, wherein the gripping elements (3, 4) close with a rotation about a rotation point (401), the length of the gripping elements (3, 4) starting from the center of rotation (401) of the rotary movement is greater than the length of the suction nozzle unit (2) starting from the center of rotation (401) of the rotary movement of the gripping elements (3, 4), and the gripping elements (3, 4) are closed with a rotary movement (401) after a laundry item has been sucked up by the suction nozzle unit (2).

6. The method according to claim 1, wherein after switching on the device to generate a vacuum, the device is operated at a first power level (201), after recognizing that a laundry item has been sucked up, the device is operated at a second power level (204), wherein the second power level is lower than the first power level.

7. The method according to claim 1, wherein a laundry item being sucked up is recognized (202) by evaluating one or more of the following variables:

Speed change of the drive unit of the device for generating a vacuum,

Power consumption of the drive unit of the device for generating a vacuum,

Change in the air flow rate when the device is switched on,

Change in pressure inside the suction nozzle unit (2),

Visual evaluation.

8. The method according to claim 1, wherein the power level at which the device for generating a vacuum in the suction nozzle unit (2) is operated is dependent on recognizing the type of fabric of the laundry item in the laundry pile (5).

9. The method according to claim 1, wherein the device for generating a vacuum is switched off if the gripping elements (3, 4) are closed (206).

10. The method according to claim 1, wherein the shape and position of the laundry pile (5) is detected, a desired position for the opening (6) of the suction nozzle unit (2) is determined from the shape and position of the laundry pile (5) in such a way that the opening (6) of the suction nozzle unit (2) is at a distance (X) from the laundry pile (5) when this desired position is reached, the gripping device (1) is moved to this target position to perform the first step.

* * * * *